US008909438B2

(12) United States Patent
Lee et al.

(10) Patent No.: US 8,909,438 B2
(45) Date of Patent: Dec. 9, 2014

(54) SWING CONTROL SYSTEM FOR HYBRID CONSTRUCTION MACHINE

(75) Inventors: Chun-Han Lee, Gimhae-si (KR); Ok-Jin Suk, Changwon-si (KR)

(73) Assignee: Volvo Construction Equipment AB, Eskilstuna (SE)

( * ) Notice: Subject to any disclaimer, the term of this patent is extended or adjusted under 35 U.S.C. 154(b) by 0 days.

(21) Appl. No.: 13/988,983

(22) PCT Filed: Dec. 7, 2010

(86) PCT No.: PCT/KR2010/008697

§ 371 (c)(1),
(2), (4) Date: May 22, 2013

(87) PCT Pub. No.: WO2012/077833

PCT Pub. Date: Jun. 14, 2012

(65) Prior Publication Data

US 2013/0245899 A1 Sep. 19, 2013

(51) Int. Cl.

| | |
|---|---|
| ***G06F 7/70*** | (2006.01) |
| ***E02F 9/12*** | (2006.01) |
| ***E02F 9/20*** | (2006.01) |

(52) U.S. Cl.

CPC ..... *E02F 9/2025* (2013.01); *E02F 9/128* (2013.01); *E02F 9/2095* (2013.01)

USPC ..... 701/50

(58) Field of Classification Search

USPC ..... 701/50

See application file for complete search history.

(56) References Cited

U.S. PATENT DOCUMENTS

| | | | | |
|---|---|---|---|---|
| 5,989,127 | A * | 11/1999 | Kitchen et al. | 472/44 |
| 2008/0073632 | A1* | 3/2008 | Kacy | 254/375 |
| 2011/0295496 | A1* | 12/2011 | Petrie et al. | 701/117 |
| 2011/0313608 | A1* | 12/2011 | Izumi et al. | 701/22 |
| 2013/0123030 | A1* | 5/2013 | Jacobi | 472/30 |
| 2013/0174556 | A1* | 7/2013 | Nishikawa et al. | 60/718 |

FOREIGN PATENT DOCUMENTS

| | | |
|---|---|---|
| JP | 2008248545 | 10/2008 |
| JP | 2009256887 | 11/2009 |
| KR | 2019920004539 | 7/1992 |

OTHER PUBLICATIONS

International Search Report mailed Sep. 29, 2011 for PCT/KR2010/008697.

* cited by examiner

*Primary Examiner* — Hussein A. Elchanti

(74) *Attorney, Agent, or Firm* — Lowe Hauptman & Ham, LLP

(57) ABSTRACT

A swing control system for a hybrid construction machine includes a swing operation lever, a hydraulic pump, an electric swing motor that makes an upper swing structure swing against a lower driving structure in accordance with an electric control signal corresponding to an operation amount of the swing operation lever, a swing parking brake released in accordance with an operation signal of the swing operation lever to drive the swing motor, a control valve which drives a hydraulic cylinder for the swing parking brake by hydraulic fluid from the hydraulic pump to release the swing parking brake if the control valve is shifted by an input of the operation signal from the swing operation lever, and a controller that controls the swing parking brake through shifting of the control valve or controls driving of the swing motor in accordance with the operation signal from the swing operation lever.

3 Claims, 3 Drawing Sheets

SWING CONTROL SYSTEM FOR HYBRID CONSTRUCTION MACHINE

CROSS REFERENCE TO RELATED APPLICATION

This application is the National Phase application of International Application No. PCT/KR2010/008697 filed on Dec. 7, 2010, which designates the United States and was published in Korean.

TECHNICAL FIELD

The present invention relates to a swing control system for a construction machine, which makes an upper swing structure swing through driving of an electric swing motor. More particularly, the present invention relates to a swing control system for a construction machine, which can automatically control stopping of an electric swing motor using a swing parking brake through a predetermined algorithm when an error occurs in a swing operation lever and the swing motor.

BACKGROUND ART

A swing control apparatus for a construction machine in the related art as illustrated in FIG. 1 includes a swing operation lever 1, a hydraulic pump 2 connected to an engine, a hydraulic swing motor 3 that makes an upper swing structure swing when the hydraulic swing motor is driven by hydraulic fluid supplied from a hydraulic pump (not illustrated), a swing parking brake 4 that is released in accordance with an input of an operation signal of the swing operation lever 1, and a control valve 6 which drives a hydraulic cylinder 5 for the swing parking brake by the hydraulic fluid from the hydraulic pump 2 to release the swing parking brake 4 if the control valve 6 is shifted by an input of the operation signal from the swing operation lever 1.

In the hydraulic swing control apparatus as described above, if the swing operation lever 1 is operated by an operator, an operation signal is supplied to an opposite side of a valve spring 6*a* of the control valve 6 to shift a spool in a downward direction in the drawing. Due to this, hydraulic fluid that is discharged from the hydraulic pump 2 is supplied to the hydraulic cylinder 5 for the swing parking brake through the shifted control valve 6 to press a spring 7. At this time, since the swing parking brake 4 that holds a swing motor shaft 8 is shifted to a release state, the swing motor 3 is driven by the hydraulic fluid from the hydraulic pump to make an upper swing structure to swing against a lower driving structure.

If an error occurs in the hydraulic swing motor 3 that makes the upper swing structure swing, a problem occurs to cause appearance of an abnormal phenomenon in the equipment. At this time, the operator can directly recognize the occurrence of the problem, and thus can take emergency measures accordingly.

On the other hand, a construction machine, such as a hybrid excavator on which a swing apparatus that makes the upper swing structure swing against the lower driving structure using an electric swing motor that is driven by electric energy is mounted, has been used.

A swing control apparatus for a hybrid construction machine in the related art is provided with a press button type emergency button which is installed in a position that the operator can easily reach during working so that the operator can recognize and immediately cope with an emergency situation where an error occurs in the electric swing device during the swing operation of the upper swing structure. Further, if the emergency situation occurs during working, the operator may pull down a safety lever to intercept main power supply to the swing motor side.

As described above, if the emergency situation occurs during working, the operator can immediately take emergency measures based on the operator's judgment.

On the other hand, in the swing control apparatus for a hybrid construction machine, the driving direction and the driving speed of the swing motor are controlled in accordance with a control signal that is transmitted from a controller (V-ECU) of the equipment. Due to this, even in the emergency situation where an electric trouble occurs in a power system such as a power conversion device for controlling the swing motor, the operator is unable to directly recognize the occurrence of the emergency situation.

Accordingly, even in the case where an emergency situation occurs in the swing device during working on a slope, the operator is unable to immediately take emergency measures, and this may cause the occurrence of secondary accidents, such as a turnover of the equipment or injury of the operator.

DISCLOSURE

Technical Problem

Therefore, the present invention has been made to solve the above-mentioned problems occurring in the related art, and one embodiment of the present invention is related to a swing control system for a hybrid construction machine, which enables an operator to escape dangerous situations and prevents damage of equipment due to abnormality of an electric swing motor through automatic restriction of driving of the swing motor in emergency situations where an error occurs in a swing operation lever and the swing motor during working.

One embodiment of the present invention is related to a swing control system for a hybrid construction machine, which enables an operator to recognize the current abnormal state of equipment and to solve the corresponding problem.

Technical Solution

In accordance with one aspect of the present invention, there is provided a swing control system for a hybrid construction machine, which includes a swing operation lever; a hydraulic pump connected to an engine; an electric swing motor that makes an upper swing structure swing against a lower driving structure in accordance with an electric control signal corresponding to an operation amount of the swing operation lever; a swing parking brake that is released in accordance with an operation signal of the swing operation lever to drive the swing motor; a control valve which drives a hydraulic cylinder for the swing parking brake by hydraulic fluid from the hydraulic pump to release the swing parking brake if the control valve is shifted by an input of the operation signal from the swing operation lever; and a controller that controls the swing parking brake through shifting of the control valve or controls driving of the swing motor in accordance with the operation signal from the swing operation lever, wherein in the case where the controller controls the driving of the swing motor through detection of an error of an input value by an operation of the swing operation lever or detection of an abnormal output torque value of the swing motor, the controller sets the swing parking brake to stop the swing motor if a swing speed of equipment is low, and the controller repeats setting/releasing of the swing parking brake at predetermined time intervals and then stops the swing motor if the swing speed of the equipment is high.

In accordance with another aspect of the present invention, there is provided a swing control system for a hybrid construction machine, including a swing operation lever, a hydraulic pump, an electric swing motor that makes an upper swing structure swing in accordance with a control signal corresponding to an operation amount of the swing operation lever, a swing parking brake that is released in accordance with an operation signal of the swing operation lever to drive the swing motor, a control valve which drives a hydraulic cylinder for the swing parking brake to release the swing parking brake if the control valve is shifted by the operation signal from the swing operation lever, and a controller that controls the swing parking brake through shifting of the control valve or controls driving of the swing motor in accordance with the operation signal from the swing operation lever, which includes a first step of receiving a torque value of the electric swing motor demanded by an operator and an actual torque value of the electric swing motor as a feedback; a second step of comparing the torque value of the swing motor demanded by the operator and the actual torque value of the swing motor with each other and determining a difference value between the compared torque values; a third step of releasing the swing parking brake if the difference value between the compared torque values of the swing motor is smaller than a torque dead zone value; a fourth step of determining whether a feedback value of a rotating speed of the swing motor exceeds a set value; a fifth step of repeating setting/releasing of the swing parking brake at predetermined time intervals till the feedback value of the rotating speed of the swing motor gets into a low-speed swing section if the torque value of the swing motor in the second step is larger than the feedback torque value and the feedback value of the rotating speed of the swing motor in the fourth step exceeds the set value; and a sixth step of setting the swing parking brake if the torque value of the swing motor in the second step is larger than the feedback torque value and the feedback value of the rotating speed of the swing motor in the fourth step is smaller than the set value.

Advantageous Effect

The swing control system for a hybrid construction machine as configured above according to the aspects of the present invention has the following advantages.

In an emergency situation where an error occurs in the swing device during working using the hybrid excavator, since the driving of the swing motor is automatically restricted by the swing parking brake, the operator is protected in the dangerous situation and the equipment is prevented from being damaged to secure reliability of the equipment.

Further, since the operator is notified of the current abnormal state, the operator can be guided to solve the corresponding problem.

BRIEF DESCRIPTION OF THE DRAWINGS

The above objects, other features and advantages of the present invention will become more apparent by describing the preferred embodiments thereof with reference to the accompanying drawings, in which.

DESCRIPTION OF REFERENCE NUMERALS IN THE DRAWING

Figure 1:
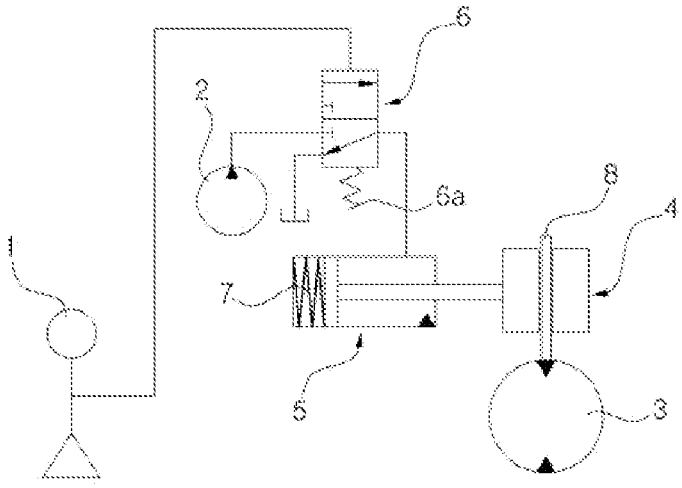
FIG. 1 is a schematic diagram of a swing control apparatus for a construction machine in the related art.

11: swing operation lever
12: hydraulic pump
13: electric swing motor
14: swing parking brake
15: hydraulic cylinder for a parking brake
16: control valve
17: controller
18: inverter
19: swing motor shaft

BEST MODE

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

Figure 3:
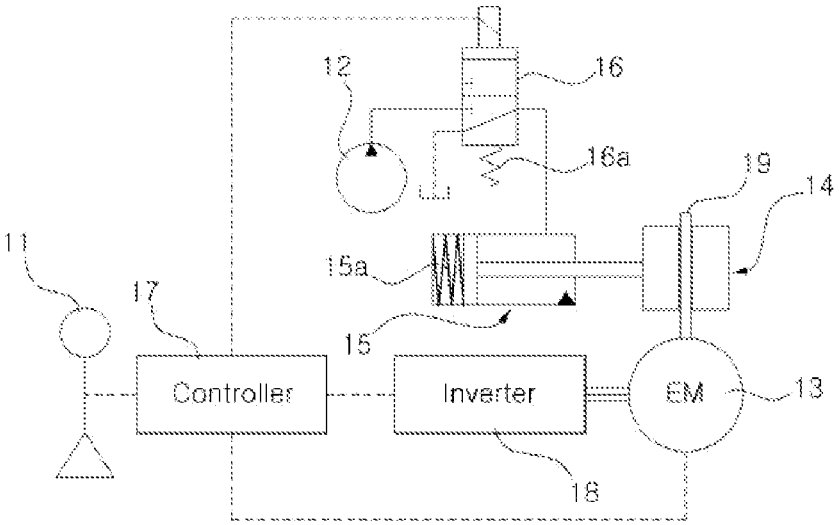
FIG. 3 is a schematic diagram of a swing control system for a hybrid construction machine according to an embodiment of the present invention.

Referring to FIG. 3, a swing control system for a hybrid construction machine according to an embodiment of the present invention includes a swing operation lever 11; a hydraulic pump 12 connected to an engine (not illustrated); an electric swing motor (EM) (hereinafter referred to as a "swing motor") 13 that makes an upper swing structure swing against a lower driving structure in accordance with an electric control signal corresponding to an operation amount of the swing operation lever 11; a swing parking brake 14 that is released in accordance with an operation signal of the swing operation lever 11 to drive the swing motor 13; a control valve (e.g., a solenoid valve) 16 which drives a hydraulic cylinder 15 for the swing parking brake by hydraulic fluid from the hydraulic pump 12 to release the swing parking brake 14 if the control valve 16 is shifted by an input of the operation signal from the swing operation lever 11; and a controller 17 that controls the swing parking brake 14 through shifting of the control valve 16 or controls driving of the swing motor 13 in accordance with the operation signal from the swing operation lever 11, wherein in the case where the controller 17 controls the driving of the swing motor 13 through detection of an error of an input value by an operation of the swing operation lever 11 or detection of an abnormal output torque value of the swing motor 13, the controller 17 sets the swing parking brake 14 to stop the swing motor 13 if a swing speed of equipment is low, and the controller 17 repeats setting/releasing of the swing parking brake 14 at predetermined time intervals and then stops the swing motor 13 if the swing speed of the equipment is high.

In the drawing, an unexplained reference numeral "18" denotes an inverter that converts DC current into AC current in accordance with the control signal from the controller 17 and supplies the AC current to the swing motor 13.

Figure 4:
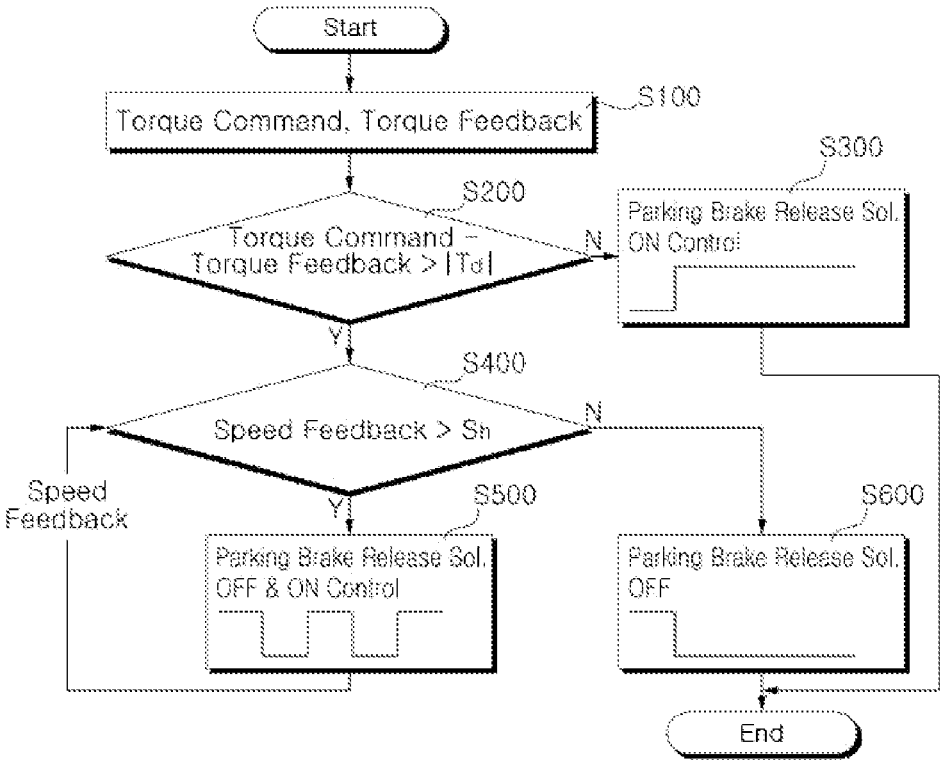
FIG. 4 is a flowchart explaining the operation of the swing control system for a hybrid construction machine according to an embodiment of the present invention.
Figure 5A:
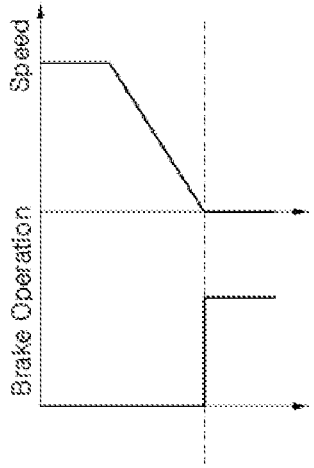
FIGS. 5A and 5B are graphs explaining speed reduction of a swing motor through a swing parking brake in a normal state and in an emergency state in a swing control system for a hybrid construction machine according to an embodiment of the present invention.
Figure 5B:
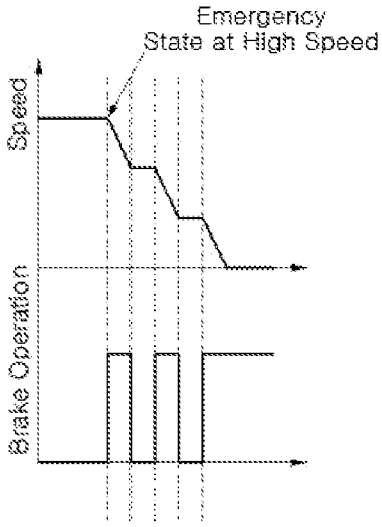

Referring to FIGS. 4, 5A and 5B, a swing control system for a hybrid construction machine according to another embodiment of the present invention, including a swing operation lever 11, a hydraulic pump 12, an electric swing motor (hereinafter referred to as a "swing motor") 13 that makes an upper swing structure swing in accordance with a control signal corresponding to an operation amount of the swing operation lever 11, a swing parking brake 14 that is released in accordance with an operation signal of the swing operation lever 11 to drive the swing motor 13, a control valve 16 which drives a hydraulic cylinder 15 for the swing parking brake to release the swing parking brake 14 if the control valve 16 is shifted by the operation signal from the swing operation lever 11, and a controller 17 that controls the swing parking brake 14 through shifting of the control valve 16 or controls driving of the swing motor 13 in accordance with the operation signal from the swing operation lever 11, the swing control system includes a first step (S100) of receiving a torque value of the swing motor 13 demanded by an operator and an actual torque value of the swing motor 13 as a feedback; a second step (S200) of comparing the torque value of the swing motor 13 demanded by the operator and the actual torque value of the swing motor 13 with each other and determining a difference value between the compared torque values; a third step (S300) of releasing the swing parking brake 14 if the difference value between the compared torque values in the second step (S200) is smaller than a torque dead zone value Td; a fourth step (S400) of determining whether a feedback value of a rotating speed of the swing motor 13 exceeds a set value Sh; a fifth step (S500) of repeating setting/releasing of the swing parking brake 14 at predetermined time intervals till the feedback value of the rotating speed of the swing motor 13 gets into a low-speed swing section if the difference value between the compared torque values in the second step (S200) is larger than the torque dead zone and the feedback value of the rotating speed of the swing motor 13 in the fourth step (S400) exceeds the set value Sh; and a sixth step (S600) of setting the swing parking brake 14 if the difference value between the compared torque values in the second step (S200) is larger than the torque dead zone and the feedback value of the rotating speed of the swing motor 13 in the fourth step (S400) is smaller than the set value Sh.

Hereinafter, use examples of the swing control system for a hybrid construction machine according to an embodiment of the present invention will be described in detail with reference to the accompanying drawings.

As shown in FIG. 3, if the swing operation lever 11 is operated by an operator, an operation signal is supplied to an opposite side of a valve spring 16*a* of the control valve 16 to shift a spool in a downward direction in the drawing. Due to this, hydraulic fluid that is discharged from the hydraulic pump 12 is supplied to the hydraulic cylinder 15 for the swing parking brake through the shifted control valve 16 to press a spring 15*a*.

At this time, since the swing parking brake 14 that supports a swing motor shaft 19 is shifted to a release state, the swing motor 13 is driven by the hydraulic fluid supplied from the hydraulic pump (not illustrated) to make an upper swing structure to swing against a lower driving structure.

On the other hand, as an input value in accordance with an operation amount of the swing operation lever 11 is input to the controller 17, a corresponding control signal from the controller 17 is output to the swing motor 13 through the inverter 18 to drive the swing motor 13.

If an error is detected from the input value in accordance with then operation of the swing operation lever 11, or abnormality (which means a case where deviation occurs between a torque output value of the swing motor 13 in accordance with the operator's operation of the swing operation lever 11 and an actual torque value of the swing motor 13) is detected from the output torque value of the swing motor 13, the controller 17 may control the driving of the swing motor 13 using the swing parking brake 14.

That is, in order to restrict the driving of the swing motor 13, the controller 17 sets the swing parking brake 14 (that is shifted to a braking state) through sifting of the control valve 16 through shifting of the control valve 16 to stop the swing motor 13 (illustrated in FIG. 5A) if the swing speed of the equipment is low. Further, the controller 17 repeats setting/releasing (shifting to a driving state) of the swing parking brake 14 at predetermined time intervals through shifting of the control valve 16 and then stops the swing motor 13 (illustrated in FIG. 5B) if the swing speed of the equipment is high.

On the other hand, if an emergency situation that the operator is unable to recognize occurs during high-speed swing of the equipment through the driving of the swing motor 13 as described above, the controller 17 controls the swing motor 13 to stop using the swing parking brake 14. This feature will be described with reference to the accompanying drawings.

As in S100 illustrated in FIG. 4, the controller 17 receives a torque value of the swing motor 13 demanded by an operator through the operation of the swing operation lever 11 and an actual torque value according to the driving of the swing motor 13 as a feedback.

In S200, the controller 17 compares the torque value of the swing motor 13 demanded by the operator and the feedback torque value of the swing motor 13 with each other and determines a difference value between the compared torque values.

That is, the controller 17 proceeds to S400 if the difference value between the torque value of the swing motor 13 demanded through the operation of the swing operation lever 11 and the actual torque value according to the driving of the swing motor 13 is larger than a torque dead zone value Td. By contrast, the controller 17 proceeds to S300 if the difference value between the torque value of the swing motor 13 demanded by the operator and the actual torque value according to the driving of the swing motor 13 is smaller than the torque dead zone value Td.

In S300, if the difference value between the torque values in step S200 is smaller than the torque dead zone value Td, the controller 17 releases the parking brake 14 to perform a normal swing operation.

In S400, the controller 17 determines whether a feedback value of a rotating speed of the swing motor 13 exceeds a set value Sh.

That is, if the feedback value of the rotating speed of the swing motor 13 exceeds the set value Sh (if the swing motor 13 is rotated at high speed), the controller 17 proceeds to S500. By contrast, if the feedback value of the rotating speed of the swing motor 13 is smaller than the set value Sh (if the swing motor 13 is rotated at low speed), the controller 17 proceeds to S600.

As in S500, if the difference value between the compared torque values according to the operator's operation of the swing operation lever 11 is larger than the dead zone torque value (see S200) and the feedback value of the rotating speed of the swing motor 13 exceeds the set value Sh (the swing motor 13 is rotated at high speed) (see S400), the controller 17 repeats setting/releasing of the swing parking brake 14 (illustrated in FIG. 5B) at predetermined time intervals till the feedback value of the rotating speed of the swing motor 13 gets into a low-speed swing section.

That is, the setting/releasing of the swing parking brake 14 may be repeated till the feedback value of the rotating speed of the swing motor 13 gets into the low-speed swing section. At this time, if the feedback value of the rotating speed of the swing motor 13 is smaller than the set value Sh, the controller 17 sets the swing parting brake 14 to stop the swing motor 13.

Figure 2:
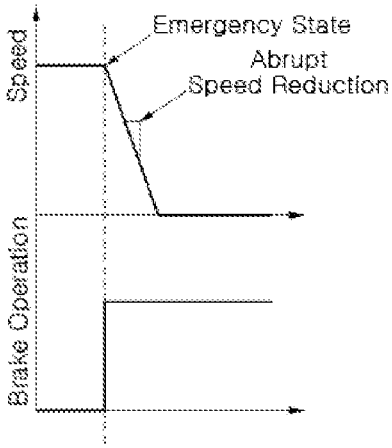
FIG. 2 is a graph explaining abrupt speed reduction of a swing motor through a swing parking brake in a swing control apparatus for a hybrid construction machine in the related art.

Through this, if the equipment swings at high speed, the controller 17 determines that an emergency situation occurs in the equipment and abruptly sets the swing parking brake 14. In this case, since the swing motor 13 is abruptly stopped, the operator may be confused to cause another dangerous situation. Further, if the swing motor shaft 19, which swings at high speed, brakes by the swing parking brake 14, it may be damaged. In particular, if an abrupt speed reduction of the swing motor 13 is performed by the swing parking brake 14, it may cause turnover of the equipment or a secondary accident that is applied to the operator in a cab (see FIG. 2).

Accordingly, if the equipment swings at high speed, the controller 17 determines that the equipment swings at high speed, and repeats the setting/releasing of the swing parking brake at predetermined intervals. Through this, the speed of the equipment, which is in a high-speed swing state, is gradually reduced to low-speed state until the feedback value of the rotating speed of the swing motor 13 gets into the low-speed swing section, and thus the swing motor 13 can be stopped in a safe state using the swing parking brake 19 (illustrated in FIG. 5B).

In S600, if the difference value between the compared torque values according to the operator's operation of the swing operation lever 11 is larger than the torque dead zone value (see S200) and the feedback value of the rotating speed of the swing motor 13 is smaller than the set value Sh (the swing motor 13 is rotated at low speed) (see S400), the controller 17 sets the swing parking brake 14 to stop the swing motor 13.

That is, in the case of switching the control valve 16 by the control signal from the controller 17 as described above, the swing parking brake 14 is shifted to a braking state through driving of the hydraulic cylinder 15 for the parking brake by the hydraulic fluid that passes from the hydraulic pump 12 to the control valve 16, and thus the swing motor 13 can be directly stopped.

As described above, if the swing motor 13 is in the low-speed rotating state, the swing motor 13 is stopped by the swing parking brake 14, and then the operator is notified of the emergency state of the equipment. Accordingly, the operator can be guided to the safe state and to solve the corresponding problem occurring in the equipment.

INDUSTRIAL APPLICABILITY

As apparent from the above description, according to the swing control system for a hybrid construction machine according the aspects of the present invention, the driving of the swing motor is automatically restricted by the swing parking brake in an emergency situation where an error occurs in the swing device during working using the hybrid excavator. Accordingly, the operator is protected in the dangerous situation and the equipment is prevented from being damaged. Further, Further, since the operator is notified of the current abnormal state, the operator can be guided to solve the corresponding problem, and thus reliability of the equipment can be secured.

The invention claimed is:

1. A swing control system for a hybrid construction machine comprising:

a swing operation lever;

a hydraulic pump connected to an engine;

an electric swing motor that makes an upper swing structure swing against a lower driving structure in accordance with an electric control signal corresponding to an operation amount of the swing operation lever;

a swing parking brake that is released in accordance with an operation signal of the swing operation lever to drive the swing motor;

a control valve which drives a hydraulic cylinder for the swing parking brake by hydraulic fluid from the hydraulic pump to release the swing parking brake if the control valve is shifted by an input of the operation signal from the swing operation lever; and a controller that controls the swing parking brake through shifting of the control valve or controls driving of the swing motor in accordance with the operation signal from the swing operation lever, wherein in the case where the controller controls the driving of the swing motor through detection of an error of an input value by an operation of the swing operation lever or detection of an abnormal output torque value of the swing motor, the controller sets the swing parking brake to stop the swing motor if a swing speed of equipment is low, and the controller repeats setting/releasing of the swing parking brake at predetermined time intervals and then stops the swing motor if the swing speed of the equipment is high.

2. A swing control method for a hybrid construction machine, the machine including a swing operation lever, a hydraulic pump, an electric swing motor that makes an upper swing structure swing in accordance with a control signal corresponding to an operation amount of the swing operation lever, a swing parking brake that is released in accordance with an operation signal of the swing operation lever to drive the swing motor, a control valve which drives a hydraulic cylinder for the swing parking brake to release the swing parking brake when the control valve is shifted by the operation signal from the swing operation lever, and a controller that controls the swing parking brake through shifting of the control valve or controls driving of the swing motor in accordance with the operation signal from the swing operation lever, the swing control method comprising:

receiving a torque value of the electric swing motor demanded by an operator and an actual torque value of the electric swing motor as a feedback;

comparing the torque value of the swing motor demanded by the operator and the actual torque value of the swing motor with each other and determining a difference value between the compared torque values;

determining whether a feedback value of a rotating speed of the swing motor exceeds a set value;

repeating setting/releasing of the swing parking brake at predetermined time intervals till the feedback value of the rotating speed of the swing motor gets into a low-speed swing section when the difference value between the compared torque values is larger than a torque dead zone value and the feedback value of the rotating speed of the swing motor exceeds the set value; and setting the swing parking brake when the difference value between the compared torque values is larger than the torque dead zone value and the feedback value of the rotating speed of the swing motor is smaller than the set value.

3. The swing control method according to claim 2, further comprising:

releasing the swing parking brake when the difference value between the compared torque values of the swing motor is smaller than the torque dead zone value.

* * * * *